US008317979B2

(12) United States Patent
Bast et al.

(10) Patent No.: US 8,317,979 B2
(45) Date of Patent: Nov. 27, 2012

(54) PAPERMAKING PICKUP FABRIC

(75) Inventors: William Bast, Prescott, AZ (US); Bob Crook, Wilson, NC (US); Calvin Hayden, Sherwood, WI (US)

(73) Assignee: Voith Patent GmbH, Heidenheim (DE)

( * ) Notice: Subject to any disclaimer, the term of this patent is extended or adjusted under 35 U.S.C. 154(b) by 205 days.

(21) Appl. No.: 12/773,313

(22) Filed: May 4, 2010

(65) Prior Publication Data

US 2011/0272111 A1 Nov. 10, 2011

(51) Int. Cl.
*D21G 9/00* (2006.01)

(52) U.S. Cl. ..... 162/289

(58) Field of Classification Search ..... 162/289, 162/358, 900; 139/383, 11
See application file for complete search history.

(56) References Cited

U.S. PATENT DOCUMENTS 4,824,525 A 4/1989 Penven
5,238,027 A 8/1993 Lee
6,213,164 B1 * 4/2001 Ostermayer et al. ... 139/383 AA
6,773,553 B2 * 8/2004 Hyvonen et al. ..... 162/358.2

FOREIGN PATENT DOCUMENTS

EP 1 473 404 A1 11/2004

OTHER PUBLICATIONS

European Search report dated Aug. 12, 2011 for European Patent Application No. EP 11 16 2920 (7 pages).

* cited by examiner

*Primary Examiner* — Mark Halpern
(74) *Attorney, Agent, or Firm* — Taylor IP, P.C.

(57) ABSTRACT

A papermaking pickup fabric having two ends seamed together with a pintle. The fabric including a first plurality of monofilament yarns directed in a machine direction, a second plurality of monofilament yarns directed in a cross machine direction, and a plurality of multifilament filler yarns. The first plurality of monofilament yarns and the second plurality of monofilament yarns being woven together to form a weave pattern. The plurality of multifilament filler yarns are captivated in the weave pattern. The first plurality of monofilament yarns forming seam loops on each of the ends in a seam loop area, said multifilament filler yarns not extending into said seem loop area.

6 Claims, 2 Drawing Sheets

PAPERMAKING PICKUP FABRIC

BACKGROUND OF THE INVENTION

1. Field of the Invention

The present invention relates to a papermaking fabric, and more particularly to, a papermaking pickup fabric joined together at two ends to form an endless pickup fabric.

2. Description of the Related Art

A woven fabric for seamed papermachine clothing generally has the warp yarns at its respective transverse end faces woven back into the fabric to form loops at each of the respective fabric ends. The ends are then placed in end-to-end disposition in order to interdigitate the loops and a pintle wire or yarn is then inserted in the interdigitated loops to lock the ends together to bring the fabric into an endless form.

Pickup fabric for use with, for example a Yankee dryer, is typically a solid monofilament woven base construct. This type of fabric has a tendency to stay clean, but is too open having too high of a void volume for many applications. It is also difficult to needle fine dtex batt layers to the woven fabric, as is needed for the Yankee Pickup fabric. A further problem with this construct is that, particularly for tissue, hydraulic wear presents a practical limit to the use of monofilament base fabrics typically used in seamed press felt construction.

What is needed in the art is a long lasting, resilient pickup fabric, resistant to wear, providing a uniform surface, with cleanliness and ease of installation.

SUMMARY OF THE INVENTION

The present invention provides, in accordance with a first aspect of the present invention, a papermaking pickup fabric having two ends seamed together with a pintle. The fabric including a first plurality of monofilament yarns directed in a machine direction, a second plurality of monofilament yarns directed in a cross machine direction, and a plurality of multifilament filler yarns. The first plurality of monofilament yarns and the second plurality of monofilament yarns being woven together to form a weave pattern. The plurality of multifilament filler yarns are captivated in the weave pattern. The first plurality of monofilament yarns forming seam loops on each of the ends in a seam loop area, said multifilament filler yarns not extending into said seem loop area.

An advantage of the present invention is that it preserves an open channel to facilitate pintle insertion.

Another advantage of the present invention is that it has a lower air permeability than the prior art.

Yet another advantage of the present invention is that there is minimal caliper increase over the prior art.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
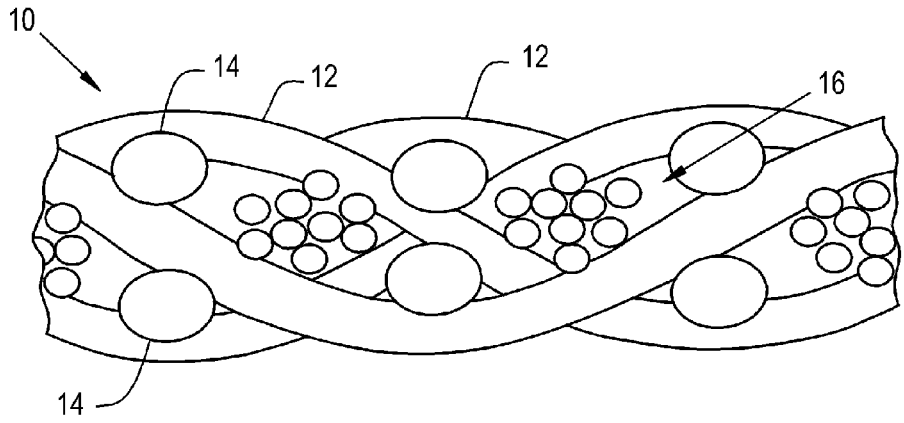
FIG. 1 is a diagrammatic cross-sectional view, illustrating a weave of an embodiment of the fabric of the present invention looking into the machine direction.
Figure 2:
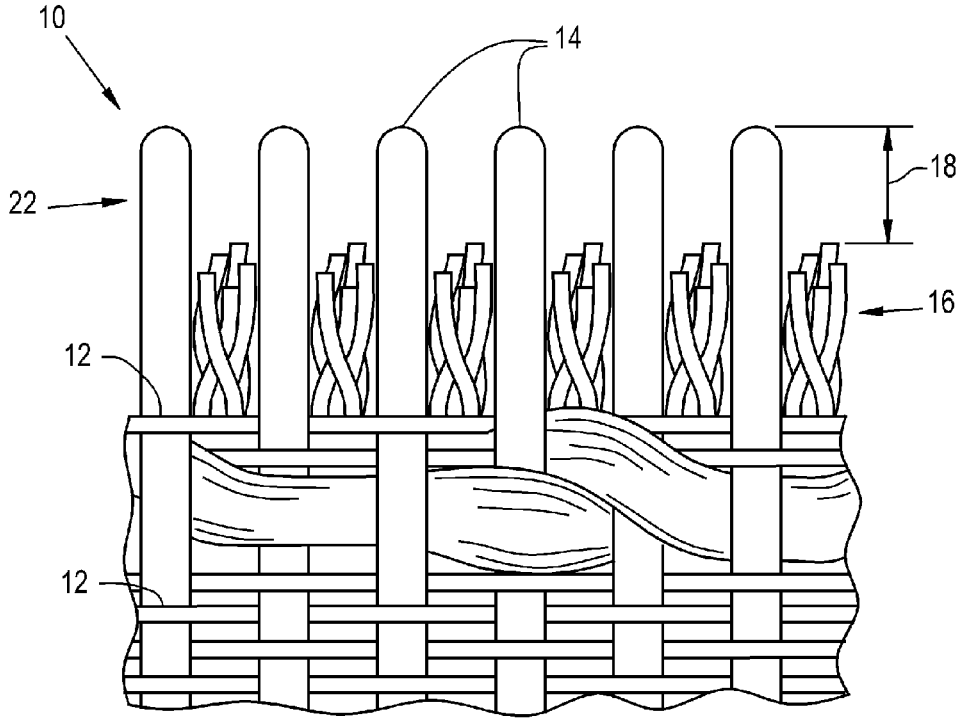
FIG. 2 is a top view of the fabric of FIG. 1 illustrating an end of the unjoined fabric.

Referring now to the drawings, and more particularly to FIGS. 1-4, there is shown the structure of a pickup fabric 10 used in a papermaking application associated with a Yankee press section, used for the production of tissue and towel type of paper. Fabric 10 includes cross-machine direction (CD) monofilament yarns 12, machine direction (MD) monofilament yarns 14 and multifilament filler yarns 16. The ends of the MD monofilament yarns 14 form seaming loops 22, which are joined by extending a pintle 20 through seaming loops 22. Seaming loops 22 are interdigitated and a pintle 20, which may be a relatively thick yarn or a multifilament yarn, is used to join the fabric ends by way of an insertion of pintle 20 into seaming loops 22.

Filler yarns 16 also known as stuffer yarns 16 are confined within the weave pattern of monofilament yarns 12 and 14. Multifilament filler yarns 16 run in the MD. The weave of monofilament yarns 12 and 14 may be referred to as a 4/4 filler weave by including multifilament filler yarns 16. Multifilament filler yarns 16 are of a plied or twisted yarn, with the yarn being selected to provide greater density and enhanced fiber bonding to fabric 10. Multifilament filler yarns 16 may, for example, be a 0.2 mm/2 ply/2 cable, or a 3 ply 630 denier multifilament yarn. Multifilament filler yarns 16 may, for example, be made from nylon 6, 6 or a low melting temperature copolymer of nylon 6 and nylon 12.

The embodiment illustrated has the multifilament filler yarns 16 weaving between the MD monofilament yarns 14, with one multifilament filler yarn 16 between each set of adjacent MD monofilament yarns 14. This provides for surprising packing with minimal caliper increase and without interfering with on machine seaming of the ends of fabric 10. As an example, a comparison was done of fabric 10 as illustrated, with a fabric without multifilament yarns 16. The weight in grams per square meter (gsm) of a 15 mil base, was 500 gsm, and was 630 gsm with a 15 mil multifilament filler yarn 16. The air permeability advantageously decreased for 1105 cubic feet per minute (cfm) to 370 cfm. The caliper of the two samples only increased from 55 mils to 58 mils. This approximately 25% increase in mass reduced the permeability by approximately ⅔ all with less than 15% increase in caliper. This is accomplished by the way multifilament filler yarns 16 pack between MD monofilament yarns 14 in the weave pattern.

Figure 3:
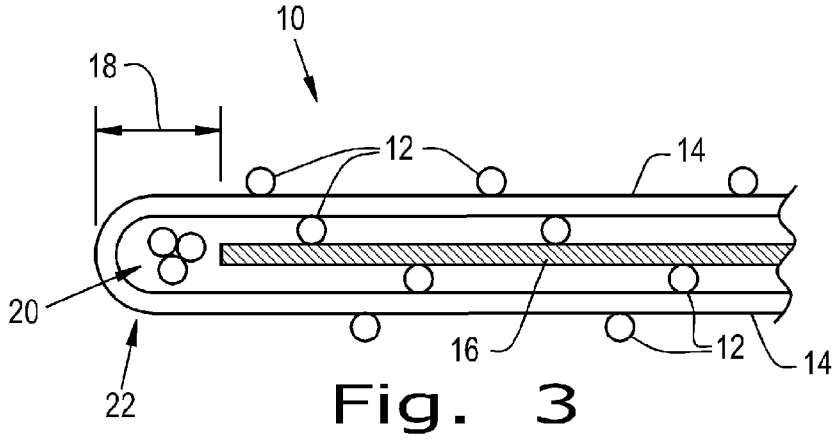
FIG. 3 is a side cross-sectional view, looking into the cross-machine direction of the fabric of FIGS. 1 and 2.
Figure 4:
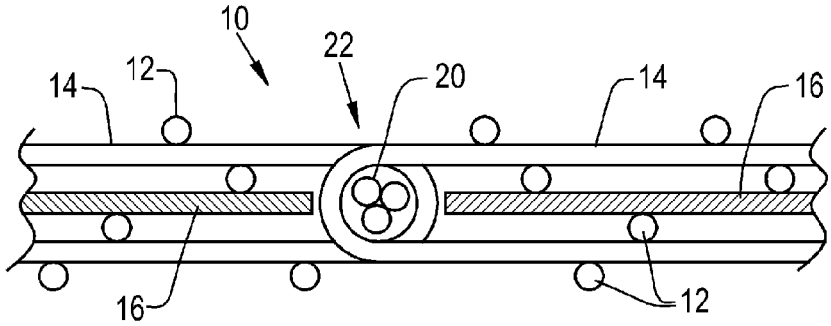
FIG. 4 is another side cross sectional view of the fabric of FIGS. 1-3, with the ends joined together with a pintle.

In the weaving of fabric 10 multifilament filler yarns 16 end prior to reaching the end of fabric 10. The distance between the end of multifilament filler yarns 16 and where MD monofilament yarns 14 turn to loop back into fabric 10 define the seaming loop area 18. This advantageously leaves a monofilament seam looping area without interference from filler yarns 16. FIG. 3 shows, for the purpose of illustration, the location of pintle 20, although pintle 20 would not normally be inserted before the interdigitating of seaming loops 22 as shown in FIG. 4. FIGS. 3 and 4 illustrate in a schematic form the captivating of multifilament filler yarns 16 within the weave pattern of monofilament yarns 12 and 14. Also illustrated is how the ends of multifilament filler yarns 16 end short of seaming loop area 18 to thereby facilitate the insertion of pintle 20.

Figure 5:
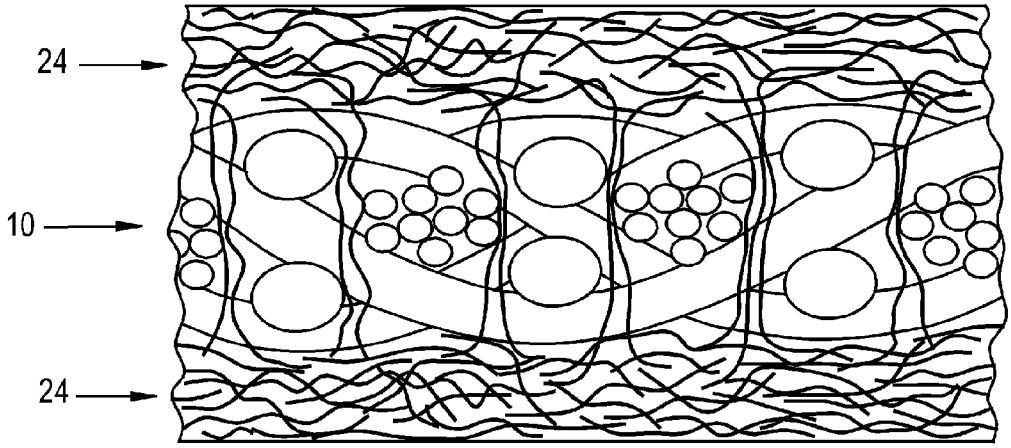
FIG. 5 is a cross-sectional view similar to FIG. 1, but including two batt layers needled thereto.

As illustrated in FIG. 5 batt layer 24 is attached to woven fabric 10 by needling. The construct of fabric 10 significantly increase the fiber locking of batt layer 24 because of the presence of multifilament filler yarns 16. While nine strands are illustrated as making up multifilament filler yarns 16, other numbers of filaments or strands are also contemplated, such as from 3 to 16 filaments. Further, multifilament filler yarn 16 may be in the form of a plied/cabled multifilament yarn, a spun yarn or even a knit yarn. Yet further, multifilament filler yarn 16 may be a bundle of filaments that are not twisted together.

In order to place the fabric on a papermaking machine, pintle 20 may be removed and the fabric opened and entwined about the rollers. The fabric is once again made endless by re-interdigitating the loops and inserting the same or a fresh pintle 20.

The invention is not restricted to the above described embodiment, and many modifications and variations can be made. For example, it is to be understood that although a batt layer has been shown on both sides of fabric 10, one batt layer could be connected to one side of fabric 10. Further the needled fibers thereof may be encapsulated using a heat process to melt multifilament yarns 16. The loops may be formed by weaving back into the fabric free warp yarns, or by helical seaming spirals which are bound into the fabric by a holding yarn.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A papermaking pickup fabric having two ends seamed together with a pintle, the fabric comprising:

a first plurality of monofilament yarns directed in a machine direction;

a second plurality of monofilament yarns directed in a cross machine direction, said first plurality of monofilament yarns and said second plurality of monofilament yarns being woven together to form a weave pattern; and a plurality of multifilament filler yarns captivated in said weave pattern, said first plurality of monofilament yarns forming seam loops on each of the ends in a seam loop area, said multifilament filler yarns not extending into said seem loop area, said multifilament filler yarns extend in said weave pattern only in said machine direction.

2. The papermaking pickup fabric of claim 1, wherein said seam loops of each of the ends are connected by way of the pintle.

3. The papermaking pickup fabric of claim 2, wherein the pintle is a multifilament yarn.

4. The papermaking pickup fabric of claim 1, wherein each of said multifilament filler yarns have from 3 to 16 filaments therein.

5. The papermaking pickup fabric of claim 1, further comprising a batt fabric layer needled to said weave pattern.

6. The papermaking pickup fabric of claim 1, wherein a corresponding one of said plurality of multifilament filler yarns is positioned between adjacent monofilament yarns of said first plurality of monofilament yarns.

* * * * *